US010156105B2

(12) United States Patent
Aamo et al.

(10) Patent No.: US 10,156,105 B2
(45) Date of Patent: Dec. 18, 2018

(54) DRILL APPARATUS FOR A FLOATING DRILL RIG

(71) Applicant: Heavelock AS, Trondheim (NO)

(72) Inventors: Ole Morten Aamo, Trondheim (NO); Sigbjorn Sangesland, Trondheim (NO)

(73) Assignee: Heavelock AS, Trondheim (NO)

( * ) Notice: Subject to any disclaimer, the term of this patent is extended or adjusted under 35 U.S.C. 154(b) by 0 days.

(21) Appl. No.: 15/546,558

(22) PCT Filed: Jan. 29, 2016

(86) PCT No.: PCT/EP2016/051982
§ 371 (c)(1),
(2) Date: Jul. 26, 2017

(87) PCT Pub. No.: WO2016/120473
PCT Pub. Date: Aug. 4, 2016

(65) Prior Publication Data

US 2018/0016858 A1 Jan. 18, 2018

(30) Foreign Application Priority Data

Jan. 29, 2015 (GB) ..... 1501477.2

(51) Int. Cl.
*E21B 47/06* (2012.01)
*E21B 21/00* (2006.01)
(Continued)

(52) U.S. Cl.
CPC ..... *E21B 21/08* (2013.01); *E21B 21/001* (2013.01); *E21B 21/103* (2013.01); *E21B 47/06* (2013.01);
(Continued)

(58) Field of Classification Search
CPC ..... E21B 19/002; E21B 19/16; E21B 21/001; E21B 21/08; E21B 21/103; E21B 47/06; E21B 7/12
See application file for complete search history.

(56) References Cited

U.S. PATENT DOCUMENTS 3,603,409 A * 9/1971 Watkins ..... E21B 7/128 166/352
3,976,148 A * 8/1976 Maus ..... E21B 7/128 175/48
(Continued)

FOREIGN PATENT DOCUMENTS

EP 0 832 817 A2 4/1998
EP 2 079 896 A2 7/2009
(Continued)

OTHER PUBLICATIONS

PCT International Search Report and Written Opinion, PCT International Application No. PCT/EP2016/051982, dated Apr. 19, 2016, 12 pages.
(Continued)

*Primary Examiner* — James G Sayre
(74) *Attorney, Agent, or Firm* — McDonnell Boehnen Hulbert & Berghoff LLP

(57) ABSTRACT

A drill string (2) for a floating drill rig, the drill string (2) comprising: a bore (4) running the length of the drill string (2) and configured to receive a drilling fluid; and a controllable dynamic flow restriction (14) in the bore, wherein the controllable dynamic flow restriction (14) is operable to restrict flow of the drilling fluid through the bore (4) and thereby generate excess pressure in the drill string when the drill string (2) moves down, and to allow additional drilling fluid to be pushed through the bore (4) and out of the fluid
(Continued)

connection under the excess pressure generated when the drill string (2) moves upward.

21 Claims, 3 Drawing Sheets

(51) Int. Cl.

| | |
|---|---|
| ***E21B 7/12*** | (2006.01) |
| ***E21B 19/16*** | (2006.01) |
| ***E21B 19/00*** | (2006.01) |
| ***E21B 21/08*** | (2006.01) |
| ***E21B 21/10*** | (2006.01) |

(52) U.S. Cl.
CPC ..... *E21B 7/12* (2013.01); *E21B 19/002* (2013.01); *E21B 19/16* (2013.01)

(56) References Cited

U.S. PATENT DOCUMENTS

| | | | | |
|---|---|---|---|---|
| 2003/0098181 | A1* | 5/2003 | Aronstam | B63B 21/502 175/65 |
| 2005/0092522 | A1* | 5/2005 | Humphreys | E21B 19/002 175/5 |
| 2008/0105434 | A1 | 5/2008 | Orbell et al. | |
| 2009/0211814 | A1 | 8/2009 | De Boer | |
| 2011/0253445 | A1* | 10/2011 | Hannegan | E21B 19/09 175/5 |
| 2012/0241163 | A1 | 9/2012 | Reitsma et al. | |
| 2014/0069720 | A1 | 3/2014 | Gray | |
| 2014/0160891 | A1 | 6/2014 | Russell | |
| 2014/0251693 | A1* | 9/2014 | Rajabi | E21B 21/08 175/66 |
| 2015/0122505 | A1* | 5/2015 | Judge | E21B 47/101 166/368 |

FOREIGN PATENT DOCUMENTS

| | | | | |
|---|---|---|---|---|
| EP | 2 378 056 | A2 | 10/2011 | |
| EP | 2 539 536 | B1 | 7/2015 | |
| GB | 2473672 | A | 3/2011 | |
| WO | 2008/058209 | A2 | 5/2008 | |
| WO | 2012/129506 | A2 | 9/2012 | |
| WO | 2014/031124 | A1 | 2/2014 | |
| WO | 2014/043396 | A2 | 3/2014 | |
| WO | 2014/055090 | A1 | 4/2014 | |
| WO | 2014/105054 | A1 | 7/2014 | |
| WO | WO-2014105054 | A1 * | 7/2014 | E21B 47/06 |
| WO | WO-2017096101 | A1 * | 6/2017 | E21B 44/00 |

OTHER PUBLICATIONS

GB Search Report, GB Application No. 1501477.2, dated Mar. 25, 2015, 5 pages.

* cited by examiner

PRIOR ART

DRILL APPARATUS FOR A FLOATING DRILL RIG

CROSS REFERENCE TO RELATED APPLICATIONS

The present application is a national stage entry of PCT/EP2016/051982, filed 29 Jan. 2016, and claims priority to GB 1501477.2 filed 29 Jan. 2015. The full disclosures of PCT/EP2016/051982 and GB 1501477.2 are incorporated herein by reference.

The present invention relates to a drill apparatus and method for a floating drill rig, and in particular to an apparatus that can allow for compensation of heave induced pressure fluctuations down hole.

A drill rig includes a drill string (including a drill pipe and drill collars) running the well bore, and a drill bit. The drill bit is located at the bottom end of the drill string (i.e. the end of the drill string opposite the end proximate the surface) and is in contact with the bottom of the well bore. During drilling, the weight of the drill string pushes down onto the drill bit, providing enough downward force to allow the drill bit to drill through rock. Whilst drilling is carried out, drilling fluid is circulated down through the drill pipe and into the drill bit, then out of the drill bit through nozzles in the drill bit, and then up towards the surface via the annulus (the annular space between the drill string and the well bore). The drilling fluid provides hydrostatic pressure to prevent formation fluids from entering into the well bore, serves to cool and lubricate the drill bit, and remove debris and cuttings from the well bore. In conventional wells, the drilling fluid flows in a circulation loop with the return flow open to atmosphere. The bottom hole pressure (BHP) is then due only to the weight of the drilling fluid. In managed pressure drilling (MPD), the drilling fluid flows within a closed circulation loop with a backpressure applied to the drilling fluid. The BHP is then due to the weight of the drilling fluid and the backpressure.

Offshore drilling may be carried out from a floating rig (for example, floating platforms, semisubmersibles or drillships). One problem associated with such rigs is that they are subject to large vertical motions (heave) due to waves and/or tides. For example, in rough weather In the North Sea, the heave amplitude may be 3 to 5 meters, with a period of 10 to 20 seconds. This heave motion must be compensated for, as it affects the pressure within the well bore.

When drilling ahead, a heave compensation system ensures that the drill bit is on the bottom with near constant weight on it. However, the heave compensation system is not operable at all times. In particular, as the drill bit advances downwards during drilling, the drill string must be extended by adding additional lengths of drill pipe and then running the extended drill string into the hole (pipe connection and tripping). During pipe connection and tripping, the drill string is held in slips (a device used to grip and hold the upper part of a drill string to the drillfloor on the rig). When the drill string is in slips the heave compensation system is turned off, and the drill string oscillates along with the heaving rig. The drill string acts as a piston in the well, and this has a major effect on the bottom hole pressure; downward movement of the drill string increases the bottom hole pressure (surging) and upward movement of the drill string decreases the bottom hole pressure (swabbing). Excessive surge and swab pressures lead to increased risk. A reduction in pressure due to swabbing can lead to kicks (the unexpected influx of formation fluids into the well bore) and potentially a blowout. High surge pressure will lead to lost circulation.

Presently, this phenomenon prohibits using floating rigs where the pressure margins are tight in locations where the waves have high amplitude such that they can cause heave motions which cause the pressure oscillations in the well to exceed the safety margins.

Recent efforts towards solving this problem have followed two paths: avoiding resonances to minimize the effect of heave and actively attenuating the heave by automatic control of the return flow choke installed in MPD systems.

For an example of avoiding resonances to minimize the effect of heave, see U. J. F. Aarsnes, O. M. Aamo, E. Hauge and A. Pavlov, "Limits of controller performance in the heave disturbance attenuation problem", *Proceedings of the European Control Conference*, July 2013. The approach of avoiding resonances is limited in that merely avoids a problem from amplifying by resonance, and thus leaves significant pressure fluctuations.

For examples of actively attenuating the heave by automatic control of the return flow choke installed in MPD systems, see for example WO-A-2012/129506, EP-A-2378056 and H. Mandianfar, O. M. Aamo and A. Pavlov, "Attenuation of heave-induced pressure oscillations in offshore drilling systems", *Proceedings of the* 2012 *American Control Conference*, June 2012.

WO-A-2012/129506 discloses a method for maintaining pressure in a well bore drilled from a floating platform. The method includes the steps of pumping fluid at a determined flow rate into the drill string and measuring fluid pressure within the fluid discharge line of fluid returning from the wellbore. The fluid discharge line has a variable length corresponding to an elevation of the floating platform above the bottom of the body of water. The wellbore pressure is determined at a selected depth in the wellbore or at a selected position along a drilling riser or variable length portion of the fluid discharge line using known parameters/methods. The determined wellbore pressure is adjusted for changes in length of the fluid discharge line corresponding to changes in the elevation of the floating platform relative to the bottom of the body of water. A backpressure system is operated to maintain the adjusted determined wellbore pressure at a set point value by applying backpressure to the wellbore.

EP-A-2378056 A discloses a system which compensates for heave induced pressure fluctuations on a floating rig when the drill string is off bottom and suspended on the rig, such when as pipe connections are made, or during tripping. A pressure relief valve or adjustable choke allows the movement of fluid from the riser when the drill string moves down, and a pump with a pressure regulator moves fluid to the riser when the drill string moves up.

Actively attenuating the heave induced pressure fluctuations by automatic control of the return flow choke can, in theory, completely attenuate pressure fluctuations at the bottom of the well. However, perfect attenuation requires perfect modelling and perfect prediction of the heave motion several seconds into the future. These requirements are difficult, or impossible, to meet in practice, as there is a high-level of uncertainty when predicting wave motion.

There is therefore a need for an improved method and apparatus for addressing heave induced pressure fluctuations for a floating drill rig.

According to a first aspect of the present invention there is provided a drill apparatus for a floating drill rig, the apparatus comprising: a drill string including a bore running the length of the drill string and configured to receive a drilling fluid; a fluid connection that allows for transfer of drilling fluid from within the drill string to outside of the drill string; and a controllable dynamic flow restriction in the bore, wherein the controllable dynamic flow restriction is operable to restrict flow of the drilling fluid through the bore and thereby generate excess pressure in the drill string when the drill string moves down, and to allow additional drilling fluid to be pushed through the bore and out of the fluid connection under the excess pressure when the drill string moves upward, whereby the transfer of drilling fluid from within the drill string to outside of the drill string is controllable via the controllable dynamic flow restriction.

Thus, pressure is increased in the drill string by restricting flow of the drilling fluid through the bore to the drill bit when the drill string moves down, and the resulting excessive pressure is used to push extra drilling fluid out of the bore via the fluid connection when the drill string moves upward. That is, the flow is increased to counteract the drill string moving out (upwards) and is decreased to counteract the drill string moving in (downwards). This removes pressure oscillations in the entire well, not just close to bottom hole. In effect, in embodiments of the invention, pressure changes in the annulus are moved inside the drill string. The fluid connection can be any suitable opening from the bore of the drill string into the well bore, such as a flow port between the bore and the annulus or an opening at the lower end of the drill string between the bore and the drill bit. The latter opening is already present in many existing drill strings, for example in drill strings used in managed pressure drilling. Pressure fluctuations within the drill string are generally more acceptable than pressure fluctuations within the well bore, as the drill string and the main pump are very robust. Moving the pressure fluctuations within the drill string allows the amplitude of oscillations in the bottom hole pressure to be greatly reduced, within the tight pressure margins applicable within some wells, particularly (but not exclusively) managed pressure drilling wells.

All existing methods of attenuating pressure fluctuations in the bottom of the well utilise equipment located on the rig, which may be several thousands of meters from the bottom hole. This means that there is a time delay between adjusting conditions at the top of the rig, and the resultant change in the bottom hole pressure. In fact, the pressure waves travelling through the well have travel times that are significant compared to the period of the waves and heave motion. For example, it may take 4 to 5 seconds for pressure waves to propagate to the bottom hole, whereas the wave period in the North Sea is about 12 seconds. Again, this makes it difficult to compensate for the heave-induced pressure oscillations.

As mentioned above, perfect attenuation requires perfect modelling and perfect prediction of the heave motion several seconds into the future. Aside from the difficulties outlined above arising from the unpredictability of the wave and heave motion, another significant problem which makes perfect modelling difficult or impossible to achieve is that in actuality the drill string does not act as a rigid piston attached to a rigid rod. Rather, the drill string shortens and extends elastically. The drill string is also able to sway from side to side, and is also able to shimmy. All of these movements are difficult to model with any accuracy. To further complicate the model, the drilling fluid may not necessarily act as a Newtonian fluid, which adds a further level of complexity to the model.

The inventors have realised that these problems exist and that they can be addressed by providing an apparatus as in the first aspect, with a controllable dynamic flow restriction located downhole in the drill string bore, thereby obviating the need for modelling of all of these complex factors and avoiding the difficult or impossible prediction of wave motion. The downhole controllable dynamic flow restriction can replace or augment flow controlling equipment at the floating rig.

As mentioned above, a significant benefit of the present approach is that pressure oscillations are small throughout the well, not just at the bottom hole. This is in contrast to the approaches in the prior art which actively attenuating the heave by automatic control of the return flow choke and which are capable only of keeping the pressure in one point steady.

The apparatus may be a managed pressure drilling apparatus.

Preferably, the drill string comprises a first, uppermost, end for connection to the floating drill rig, and a second, lowermost, end for connection to a drill bit, and the controllable dynamic flow restriction is located closer to the second end than to the first end. That is, the controllable dynamic flow restriction is located downhole, and preferably close to the bottom hole assembly (comprising the drill collars and drill bit). By "close" it is meant that the controllable dynamic flow restriction is located in the vicinity of the bottom hole assembly, such that the time it takes for the pressure waves to travel between the controllable dynamic flow restriction and the bottom hole is negligible compared to the period of the waves. Thus, the controllable dynamic flow restriction may be provided less than 1 km from the second end, optionally 500 meters from the second end, possibly less than 100 meters from the second end, and in some cases less than 50 meters from the second end. The flow restriction may be located wherever is convenient for installation of a suitable device into the drill string. Close proximity to the end of the drill string is an advantage, but it is not essential to have a very short distance since reductions in pressure oscillations can be achieved with a larger distance as well, especially with larger drill string lengths.

The controllable dynamic flow restriction is preferably located above the fluid connection that allows for transfer of drilling fluid out of the drill string. This allows for the fluid connection to open directly into the bore through the tool/the drill string, with the pressure of the drill fluid at the fluid connection hence being directly influenced by the controllable dynamic flow restriction.

The controllable dynamic flow restriction may be a choke valve.

The drill string may comprise a sensor for measuring the motion of the drill string (in which case, the sensor may measure the velocity or acceleration of the drill string), and/or a sensor for measuring the pressure of the drilling fluid inside the bore of the drill string (preferably above and below the restriction), and/or a sensor for measuring the main pump flow rate of the drilling fluid, and/or a sensor for measuring the pressure of the drilling fluid outside of the drill string, i.e. within the annulus. The drill string may further comprise a controller for controlling the size of the controllable dynamic restriction responsive to information from the sensor(s). Where a controller and sensor(s) are provided, these may be provided proximate the controllable dynamic restriction. Alternatively, if the drill string is in communication with the drill rig, for example if it is a wired string, then the controller may be located on the drill rig (i.e. not downhole).

As noted above, the fluid connection allowing drilling fluid to transfer from inside the drill string to outside the drill string can be any suitable opening from the bore of the drill string into the well bore. In some examples the drill string includes as a flow port between the bore and the annulus. In this case the controllable dynamic flow restriction may be located above the flow port, or alternatively the flow port may include a dynamic flow restriction valve with a closure device being located below the flow port and in the bore, with the closure device and the dynamic flow restriction valve acting together to provide the functionality of the controllable dynamic flow restriction. In the first arrangement the controllable dynamic flow restriction is separate to the flow port and controls flow of fluid above the flow port so that when it is open then flow occurs through the bore and out of the flow port, and when it is closed then there is no flow through the bore. The flow port can be a fluid passage without any control of the flow therethrough, i.e. it may be an open hole. In the second arrangement the controllable dynamic flow restriction is formed by combination of the closure device in the bore and the dynamic flow restriction valve in the flow port. When the closure device in the bore is open then fluid can flow through the bore via the drill bit (as well as optionally through the flow port) and out of the drill string. When the closure device in the bore is closed then dynamic flow restriction valve in the flow port controls the flow of fluid out of the drill string and the flow of fluid will stop when it is also closed.

The flow port may be at any location on the drill string where it will communicate effectively with drill fluid in the annulus. Thus, the flow port may be relatively close to the second end of the drill string where drill fluid will always be present. The flow port may for example be above the second end and less than 1 km from the second end, optionally 500 meters from the second end, possibly less than 100 meters from the second end, and in some cases less than 50 meters from the second end. As with the location of the flow restriction discussed above, close proximity to the lowermost end of the drill string can be an advantage but it is not essential.

The fluid connection may alternatively or additionally include an opening at the second end of the drill string between the bore and the drill bit. This may be an opening used for circulation of the drilling fluid as discussed below.

Thus, the drill apparatus may have a fluid connection for transfer of drilling fluid from the end of the bore at the second, lowermost, end of the drill string and through the drill bit to the outside of the drill string, and the drill apparatus may alternatively or additionally have a fluid connection for transfer of drilling fluid from a point above the second end of the drill string out of the drill string to the annulus, such as the flow port described above. In this way the apparatus and its controllable dynamic flow restriction can act to restrict flow through the bore when the drill string moves down (and prevent flow through the fluid connection(s)), and allow additional drilling fluid to be pushed through the bore to the fluid connection(s) and out of the drill string when the drill string moves upward. As noted above, a controller may be used to allow for increased flow through the flow restriction during upward movement of the drill string, and decreased flow through the flow restriction during downward movement of the drill string. Drill fluid can flow through the entirety of the bore and out of the drill string, for example, via an opening at the lowermost end of the bore (such as via the drill bit), or it may flow through just a part of the length of the bore, preferably a majority of the length of the bore, and out of the drill string via a flow port that is above the lowermost end of the bore.

Preferably, the drilling fluid is continuously circulated through the drill string and the annulus. Thus, the apparatus may be a continuous circulation apparatus, which can have features as in known continuous circulation drilling systems. The use of such a system means that there is a convenient fluid connection that already allows for transfer of drilling fluid between the drilling fluid within the drill string and the drilling fluid outside of the drill string, at the bottom hole. Such a fluid connection is necessarily present for a continuous circulation system and may, for example, take the form of an opening at the lower end of the drill string where the bore opens into the hole via the drill bit as explained above. When a continuous circulation system is used then the only significant adaptation to the system is the addition of the controllable dynamic flow restriction, since the continuous circulation system provides the other fluid connection features required to transfer drilling fluid into the drill string. Optionally, an additional fluid connection can be provided, for example a flow port as described above, which may open into the annulus above the drill string lower end.

In some embodiments, the controllable dynamic flow restriction, sensor(s) and controller are all provided in a dedicated downhole tool (also referred to as a "sub" or "sub-surface tool"). This has the advantage that the downhole tool can potentially function independently without communication or control from the drill rig. The downhole tool may be fitted as part of the bottom hole assembly, or may be fitted anywhere in between drill string pipe segments in the drill string.

Therefore, according to a second aspect of the invention, there is provided a downhole tool for connection within a drill string of a drill apparatus for a floating drill rig, the downhole tool comprising: a bore running through the downhole tool and configured to receive drilling fluid; a fluid connection that allows for transfer of drilling fluid from within the bore to outside of the drill string; a controllable dynamic flow restriction in the bore; a sensor; and a controller for controlling the size of the controllable dynamic flow restriction responsive to information from the sensor in order to control the transfer of drilling fluid from within the drill string to outside of the drill string via the controllable dynamic flow restriction, such that when in use within a drill string the controllable dynamic flow restriction can be used to restrict flow of the drilling fluid through the bore and thereby generate excess pressure in the drill string when the drill string moves down, and to allow additional drilling fluid to be pushed through the bore and out of the fluid connection under the excess pressure when the drill string moves upward.

The sensor provided in the downhole tool may be configured to measure the motion of the downhole tool, (in which case, the sensor may measure the velocity or acceleration of the downhole tool) and/or may be configured to measure the pressure of the drilling fluid inside the bore of the downhole tool (preferably above and below the restriction) and/or may be configured to measure the flow rate of the drilling fluid, and/or may be configured to measure the pressure in the drilling fluid outside of the downhole tool, i.e. within the annulus. The downhole tool may include multiple sensors to carry out the various sensing functions. The controllable dynamic flow restriction may be as described above in relation to the first aspect.

The invention also extends to a drill apparatus with a drill string comprising the downhole tool of the second aspect, and also the preferred features thereof set out above. This drill apparatus may also have the preferred features of the apparatus set out above under the first aspect. For example, the drill string may comprise a first end for connection to the floating drill rig, and a second end for connection to a drill bit, and the downhole tool may be located closer to the second end than to the first end, i.e. close to the bottom hole assembly. The downhole tool may be provided less than 1 km from the second end, optionally 500 meters from the second end, possibly less than 100 meters from the second end, and in some cases less than 50 meters from the second end. The controllable dynamic flow restriction may be a choke valve. The controller may control the size of the controllable dynamic restriction responsive to information from the sensor. The drilling fluid may be continuously circulated through the drill string and the annulus. Thus, the apparatus may be a continuous circulation apparatus.

The invention also extends, in another aspect, to a floating drill rig comprising the drill apparatus or downhole tool of the foregoing aspects, also optionally including the preferred features thereof. The floating rig may be a managed pressure drill rig.

According to a further aspect of the present invention there is provided a method for reducing pressure fluctuations in bottom hole pressure generated by the heaving motion of a floating drill rig, wherein the floating drill rig comprises a drill string configured to receive a drilling fluid through a bore thereof, and a fluid connection which allows for transfer of drilling fluid from within the drill string to outside of the drill string, the method comprising: controlling the transfer of the drilling fluid from within the drill string to outside of the drill string by restricting flow of the drilling fluid through the bore to generate excess pressure in the drill string when the drill string moves down and allowing additional drilling fluid to be pushed through the bore under the excess pressure when the drill string moves upward.

The method may include the use of features as described above in relation to any of the prior aspects. The method may comprise providing a controllable dynamic flow restriction in the drill string, preferably a choke valve. The drill string may comprise a first end for connection to the floating drill rig, and a second end for connection to a drill bit, and the controllable dynamic flow restriction is preferably located closer to the second end than to the first end. Preferably, the controllable dynamic flow restriction is located close to the second end, i.e. in the vicinity of the bottom hole assembly. Thus, the controllable dynamic flow restriction may be provided less than 1 km from the second end, optionally 500 meters from the second end, possibly less than 100 meters from the second end, and in some cases less than 50 meters from the second end. The fluid connection may be as discussed above in relation to the first aspect, and the controllable dynamic flow restriction is preferably above the fluid connection.

The method may comprise measuring the motion of the drill string, and/or measuring the pressure of the drilling fluid, and/or measuring the flow rate of the drilling fluid. The method may preferably include controlling the size of the controllable dynamic restriction responsive to the motion of the drill string and/or the pressure of the drilling fluid and/or the flow rate of the drilling fluid.

The drilling fluid may be continuously circulated through the drill string and out of the drill string (i.e. into the annulus). The method may be utilised during managed pressure drilling, i.e. in a managed pressure drilling well.

The method may comprise making a pipe connection and/or tripping whilst the drill string is held in slips.

According to a further aspect, the invention provides a method for reducing pressure fluctuations in bottom hole pressure generated by the heaving motion of a floating drill rig, the method comprising using the drill apparatus or the downhole tool or the floating drill rig described above.

Preferred features of each aspect of the invention may be combined with the other aspects of the invention, and optionally with preferred features of the other aspects, as far as is applicable or appropriate.

Certain preferred embodiments of the invention will now be described by way of example only and with reference to the accompanying drawings in which.

Figure 1:
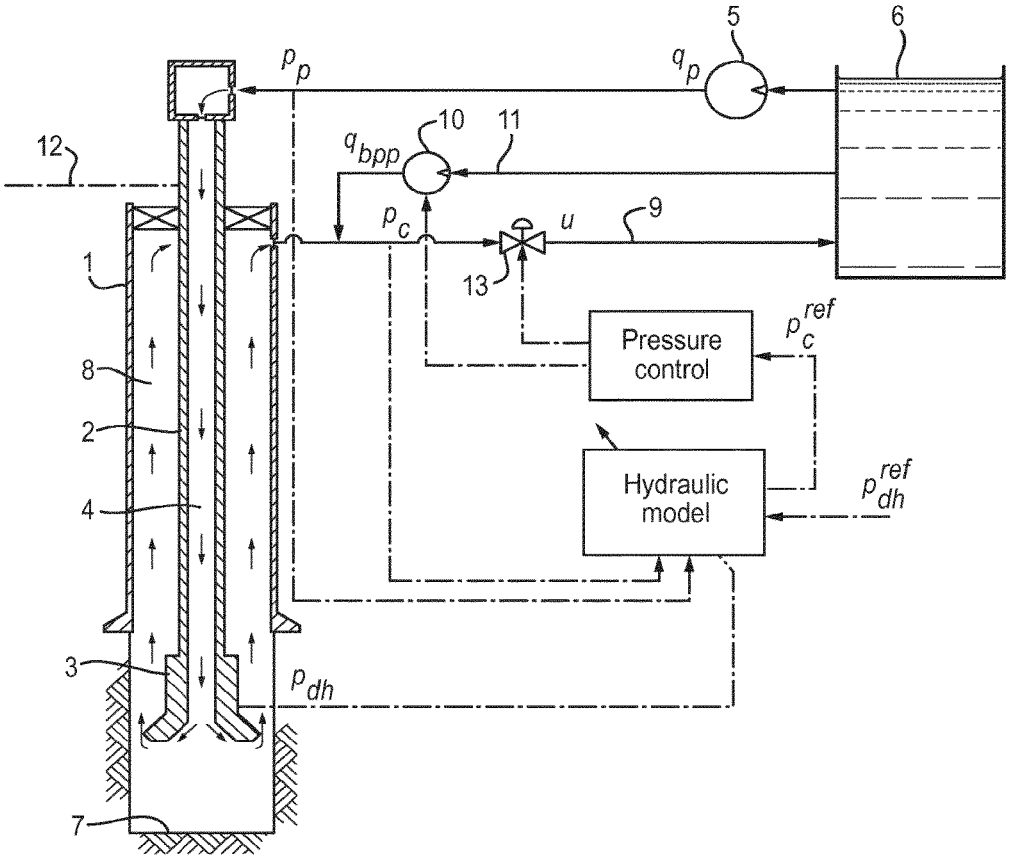
FIG. 1 shows a prior art managed pressure drilling well.

The conventional managed pressure drilling well 1 shown in FIG. 1 comprises a drill string 2 and a drill bit 3. The drill string comprises a bore 4, which runs the length of the drill string from a first end for connection to the floating drill rig, to a second end for connection to the drill bit 3. The drill string 2 is in fluid communication with a main pump 5. The main pump 5 pumps drilling fluid (under pressure $p_p$) from a drilling fluid reservoir 6 on the drill rig (not shown) and down though the bore 4 to the drill bit 3. The weight of the drill string 2 and drilling fluid pushes the drill bit 3 towards the bottom 7 of the well. The drilling fluid exits the drill bit 3 through nozzles (not shown) and then circulates upwards through the annulus 8 (the annular space between the inner surface of the well 1 and the drill string 2). Therefore, the drilling fluid is continuously circulated through the drill string 2 and out of the drill string 2 into the annulus 8. The drilling fluid then exits the well 1 via a return pipe 9 to the drilling fluid reservoir 6. A back pressure pump 10 in pipe 11 from the drilling fluid reservoir 6 applies a backpressure to the drilling fluid in the annulus 8 of the well 1.

If the drill string 2 moves relative to the bottom 7 of the well, as may happen when the drill string is held fixed relative to the drill floor 12 in slips (for example during pipe connection and/or tripping) whilst the drill floor 12 itself is moving as a result of the heaving motion of the floating drill rig, then the pressure downhole ($P_{dh}$) and bottom hole pressure (BPA) fluctuate as a result of the movement of the drill string 2. The drill string 2 acts as a piston in the well 1; downward movement of the drill string 2 increases the BPA (surging) and upward movement of the drill string 2 decreases the BPA (swabbing). Excessive surge and swab pressures lead to increased risk. A reduction in pressure due to swabbing can lead to kicks (the unexpected influx of formation fluids into the well bore) and potentially a blowout. High surge pressure will lead to lost circulation.

To attempt to compensate for the pressure fluctuations resulting from the movement of the drill string 2, prior art systems include a controllable choke valve 13 in the return pipe 9. This choke valve 13 is provided on the floating drilling rig, rather than downhole. The choke valve 13 is controlled via pressure logic and a hydraulic model, these features also being provided on the rig, rather than downhole.

The problem with such prior art systems is that the distance from the drill floor 12 to the bottom 7 of the well 1 may be of the order of several thousands of meters. This means that there is a time delay between adjusting conditions at the top of the rig (i.e. at about the level of the drill floor 12) and the resultant change in the BPA. In fact, the pressure waves travelling through the well 1 have travel times that are significant compared to the wave period. For example, it may take about 5 seconds for pressure waves to propagate to the bottom hole 7, whereas the wave period in the North Sea is about 12 seconds. This makes it difficult to compensate for the heave-induced pressure oscillations in the prior art system of FIG. 1.

Figure 2:
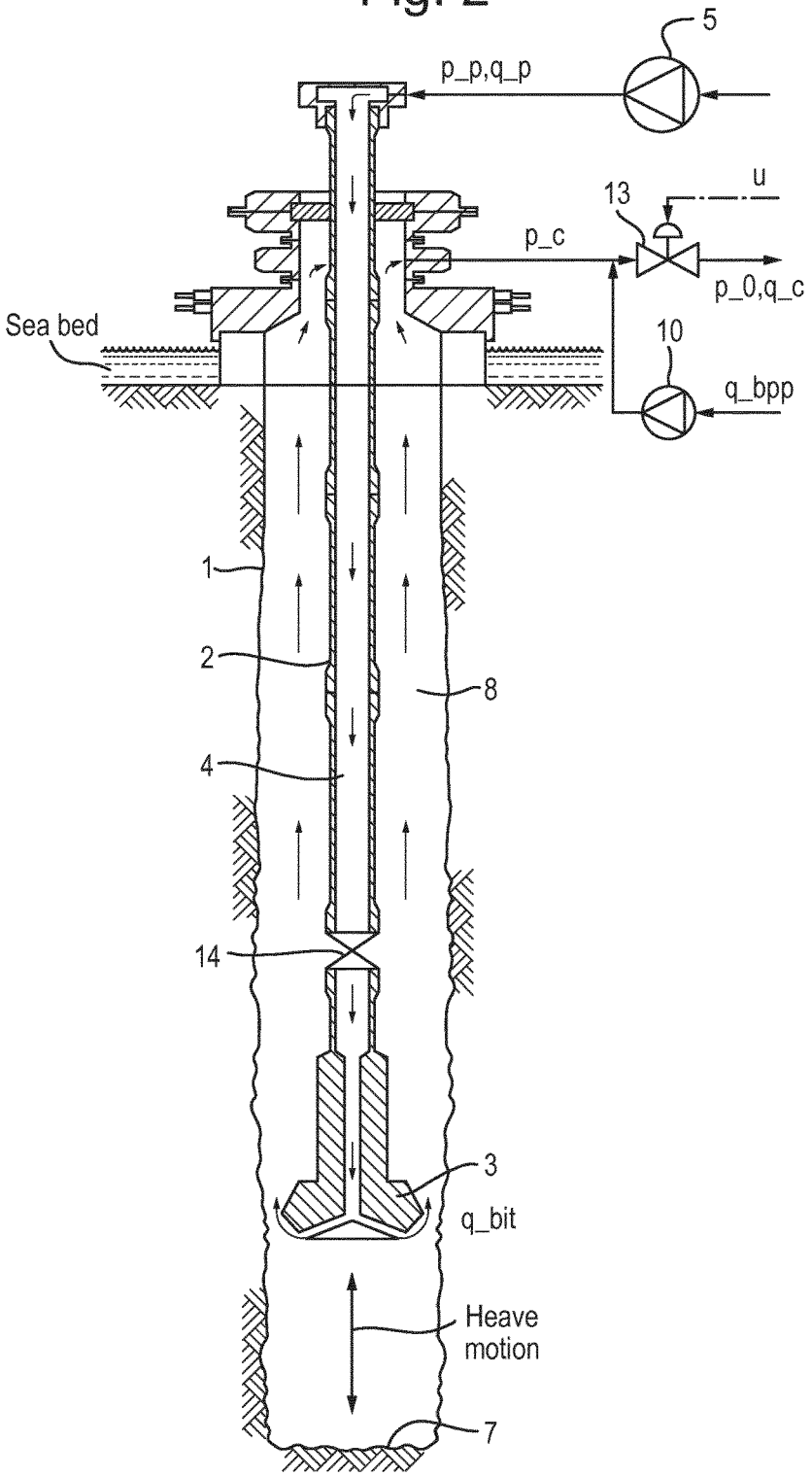
FIG. 2 shows a managed pressure drilling well according to an embodiment of the invention.

FIG. 2 shows a managed pressure drilling well in accordance with an embodiment of the present invention. Compared to FIG. 1, like features are shown with like reference numbers, and description of the common features is omitted.

The drill string 2 shown in FIG. 2 incorporates a controlled restriction 14, which restricts flow of the drilling fluid within the bore 4 of the drill string 2. The controlled restriction 14 is operable to restrict flow of the drilling fluid through the bore 4 when the drill string 2 moves down (due to the motion of the heaving floating rig), and to allow additional drilling fluid to be pushed through the bore 4 under the excess pressure generated when the drill string 2 moves upward. The controlled restriction 14 is provided downhole, closer to the second end of the drill string 2 than the first end, i.e. close to the drill bit 3. In this embodiment, the controllable restriction 14 is located 50 meters from the bottom hole assembly. The controlled restriction 14 is a choke valve. The flow path from the bore 4 to outside of the drill string 2 via the nozzles and the drill bit 3 forms a fluid connection for transfer of fluid from inside of the drill string 2 to outside of the drill string 2.

The controlled restriction 14 is controlled by a controller (not shown) which receives information from sensors which measures the motion (the velocity) of the drill string, the pressures above and below the restriction 14, and the flow of drilling fluid from the main pump 5. On the basis of this information, the controller controls the size of the controlled restriction 14 to change the amount of flow of drilling fluid through the controlled restriction 14.

A simple control strategy for the controlled restriction 14 can be taken as:

$$q_s = q_p - Av_d, \qquad \text{Equation 1}$$

where $q_s$ is the volumetric flow through the restriction, $q_p$ is the main pump flow, A is the cross sectional area of the drill string bore 4, and $v_d$ is the velocity of the heaving drill bit 3 (positive when moving downwards). The rationale behind Equation 1 is simply to increase and decrease the flow of the drilling fluid according to the volume change resulting from the drill string moving up and down. Assuming that the restriction obeys a simple choke equation, we have:

$$q_s K(u)\sqrt{p_p - p_d} \qquad \text{Equation 2}$$

where K is a strictly increasing function, i.e. the choke characteristic, u is the choke opening and $p_p$ and $p_d$ are pressures above and below the restriction, respectively. As a non-limiting example, K(u) may be a linear function, i.e. K(u)=ku, where k is a constant that is greater than zero.

The desirable choke opening can be computed as:

$$u = K^{-1}\left(\frac{q_p - Av_d}{\sqrt{p_p - p_d}}\right) \qquad \text{Equation 3}$$

This is a very simple control strategy, yet works well in simulations. More sophisticated control strategies taking dynamics, as well as additional measurements, into account may also be considered, of course. For example, the foregoing exemplary control strategy utilises two pressures, $p_p$ and $p_d$, which are both measured within the bore of the drill string ($p_p$ is measured above the choke valve, and $p_d$ is measured below the choke valve). However, alternative control strategies may make use of pressure(s) measured outside of the bore of the drill string, in the annulus.

Simulations with the simple control example explained above were carried out for a well of length 5000 meters with the controlled restriction 14 installed 50 meters from the drill bit 3.

Figure 3:
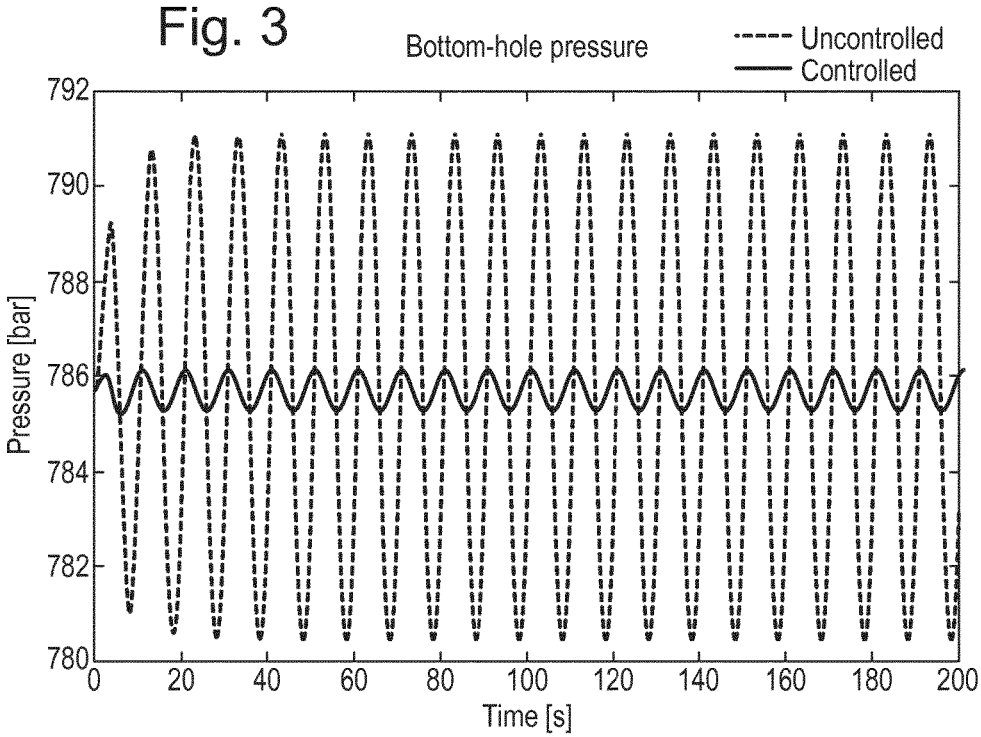
FIG. 3 shows a comparison of the bottom hole pressure for uncontrolled oscillations and controlled oscillations in a simulation for a single sine disturbance.
Figure 4:
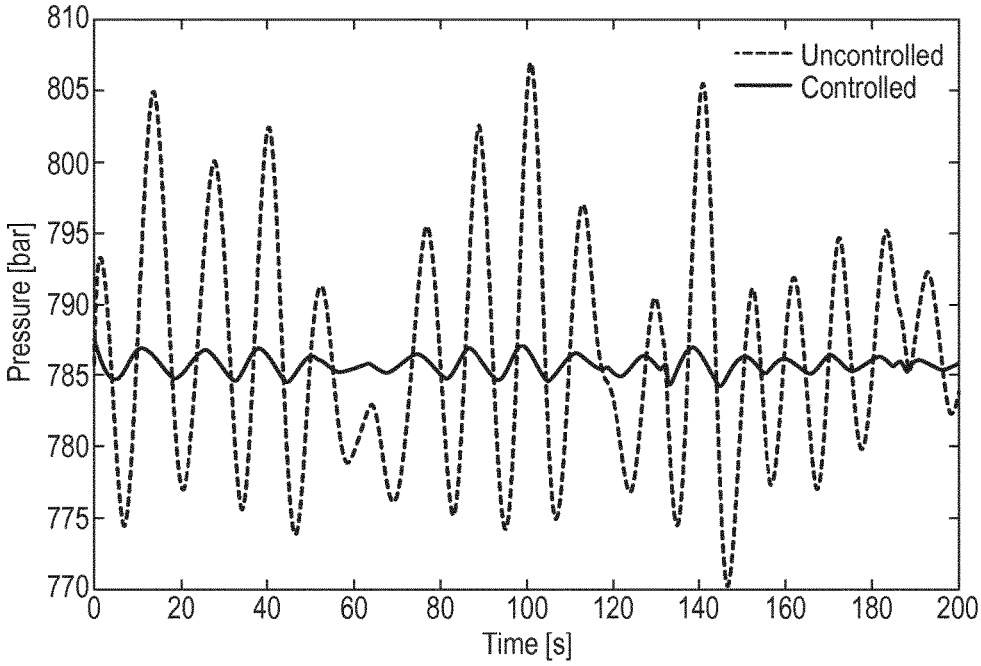
FIG. 4 shows a comparison of the bottom hole pressure for uncontrolled oscillations and controlled oscillations in a simulation for a realistic disturbance taken from heave data on an existing rig.

FIG. 3 shows a comparison of the bottom hole pressure for uncontrolled oscillations and controlled oscillations in a simulation for a simple sine-wave disturbance, and FIG. 4 shows a comparison of the bottom hole pressure for uncontrolled oscillations and controlled oscillations for a more realistic disturbance taken from actual heave data. The pressure fluctuations in the controlled case are much reduced compared to the uncontrolled case, due to the action of the controlled restriction 14.

The simulations were performed using the following model:

$$\text{Drill pipe: } \frac{\partial p_p}{\partial t} = -\frac{\beta_p}{A_p}\frac{\partial q_p}{\partial z},$$

$$\frac{\partial q_p}{\partial t} = -\frac{A_p}{\rho}\frac{\partial p_p}{\partial z} - \frac{f_p}{\rho}(q_p - A_p v_d) - A_p g,$$

$$\text{for } (t, z) \in [0, \infty) \times (0, L) \setminus L_s,$$

$$\text{Annulus } \frac{\partial p_a}{\partial t} = -\frac{\beta_n}{A_a}\frac{\partial q_a}{\partial z},$$

$$\frac{\partial q_a}{\partial t} = -\frac{A_a}{\rho}\frac{\partial p_a}{\partial z} - \frac{1}{\rho}(f_a q_a + f_{ad} A_a v_d) - A_a g,$$

$$\text{for } (t, z) \in [0, \infty) \times (0, L),$$

Bottom hole pressure:

$$\dot{p}_b(t) = \frac{\beta_b}{V_b}(q_p(t, L) - q_a(t, 0) + A_p v_d),$$

Boundary conditions $$q_p(t, 0) = Q_p,\ q_p(t, L) = K_b\sqrt{\max\{p_p(t, L) - p_b(t), 0\}},$$

$$q_p(t, L_s) = K(u)\sqrt{p_p(t, L_s^-) - p_p(t, L_s^+)},$$

$$q_a(t, 0) = K_a \operatorname{sign}(p_b(t) - p_a(t, 0))\sqrt{|p_b(t) - p_a(t, 0)|},$$

$$q_a(t, L) = K_c \operatorname{sign}(p_a(t, L) - p_0)\sqrt{|p_a(t, L) - p_0|}.$$

Here, A is a cross-sectional area, β is an effective bulk modulus, p is a pressure, f is a friction coefficient and q is a volumetric flow rate. The subscripts p and a for each of the foregoing parameters refer to parameters for the drill string bore and the annulus, respectively. The friction coefficient $f_{ab}$ is a friction coefficient governing the additional friction drop in the annulus due to the movement of the drill string. In addition, t is time, g is the acceleration due to gravity, ρ is density, $p_b$ is the pressure at the bottom hole (in the annulus below the BHA), $Q_p$ is the pump volumetric flow rate, L is the depth of the well (and $L_s$ is the location at which the restriction is installed), and $p_0$ is atmospheric pressure. Additionally, z is the distance down the well in the drill string bore (z=0 at the top) and up the well in the annulus (z=0 at the bottom), so z increases in the direction of the flow in both the drill string bore and the annulus. Finally, $v_d$ is the velocity of the heaving drill bit, and $V_b$ is volume in the annulus below the bit.

The model was discretized using finite differences on a staggered grid (100 pressure nodes and 100 flow nodes each for the drill pipe and the annulus).

In view of the foregoing, it will be appreciated that the proposed system provides a significant improvement to existing technologies for heave-compensation for a floating drill rig. In particular, the use of the controllable dynamic flow restriction results in pressure changes in the annulus being moved inside the drill string so that the amplitude of oscillations in the bottom hole pressure are greatly reduced. Further, this allows pressure oscillations to be controlled throughout the well, not just at the bottom hole. There is no need for highly complex models describing the behaviour of the waves, and the response of the drill string and drilling fluid to the heave motion.

As explained above, in the example of FIG. 2 the flow path from the bore 4 to outside of the drill string 2 via the nozzles and the drill bit 3 forms a fluid connection for transfer of fluid from inside of the drill string 2 to outside of the drill string 2. It will be appreciated that other fluid connections could be used as well as or instead of this arrangement in order to allow for the transfer of drill fluid from inside to outside of the drill string with the rate of transfer being influenced by the controllable dynamic flow restriction. One possible alternative is the use of a flow port for flow of fluid from the bore to the annulus, with the controllable dynamic flow restriction being either in the bore above the flow port or with the controllable dynamic flow restriction including a dynamic flow restriction valve in the flow port and a closure device in the bore below the flow port. In this case the flow restriction can be used in the same way to influence the flow of fluid through the fluid connection, achieving the same advantages in terms of transferring pressure fluctuations into the drill string during motion of the drill string.

We claim:

1. A drill apparatus for a floating drill rig, the apparatus comprising:

a drill string including a bore running the length of the drill string and configured to receive a drilling fluid;

a fluid connection that allows for transfer of drilling fluid from within the drill string to outside of the drill string; and a controllable dynamic flow restriction in the bore, wherein the controllable dynamic flow restriction is operable to restrict flow of the drilling fluid through the bore and thereby generate excess pressure in the drill string when the drill string moves down, and to allow additional drilling fluid to be pushed through the bore and out of the fluid connection under the excess pressure when the drill string moves upward, whereby the transfer of drilling fluid from within the drill string to outside of the drill string is controllable via the controllable dynamic flow restriction.

2. A drill apparatus according to claim 1, wherein the drill string comprises a first end for connection to the floating drill rig, and a second end for connection to a drill bit, and the controllable dynamic flow restriction is located closer to the second end than to the first end.

3. A drill apparatus according to claim 2 wherein the controllable dynamic flow restriction is provided less than 500 meters from the second end.

4. A drill apparatus according to claim 1, wherein the controllable dynamic flow restriction is a choke valve.

5. A drill apparatus according to claim 1, comprising a sensor for measuring the motion of the drill string, wherein the sensor measures the velocity or acceleration of the drill string.

6. A drill apparatus according to claim 5, comprising a controller for controlling the size of the controllable dynamic restriction responsive to information from the sensor(s).

7. A drill apparatus according to claim 6, wherein the controller is operable to control the size of the controllable dynamic restriction on the basis of:

the pressure of the drilling fluid above and below the controllable dynamic restriction;

the flow rate of drilling fluid from the main pump; and the velocity of the drill string.

8. A drill apparatus according to claim 1, comprising: a sensor for measuring the pressure of the drilling fluid inside the bore of the drill string, above and below the controllable dynamic restriction; and/or a sensor for measuring the pressure of the drilling fluid outside of the drill string.

9. A drill apparatus according to claim 1, comprising a sensor for measuring the flow rate of drilling fluid from the main pump.

10. A drill apparatus according to claim 1, wherein the fluid connection that allows for transfer of drilling fluid from within the drill string to outside of the drill string includes an opening at a lowermost end of the drill string through a drill bit.

11. A drill apparatus according to claim 1, wherein the fluid connection that allows for transfer of drilling fluid from within the drill string to outside of the drill string includes a flow port allowing flow between the bore inside the drill string and an annulus outside of the drill string.

12. A downhole tool for connection within a drill string of a drill apparatus for a floating drill rig, the downhole tool comprising:

a bore running through the downhole tool and configured to receive drilling fluid;

a fluid connection that allows for transfer of drilling fluid from within the bore to outside of the drill string;

a controllable dynamic flow restriction in the bore;

a sensor; and a controller for controlling the size of the controllable dynamic restriction responsive to information from the sensor in order to control the transfer of drilling fluid from within the drill string to outside of the drill string via the controllable dynamic flow restriction, such that when in use within a drill string the controllable dynamic flow restriction can be used to restrict flow of the drilling fluid through the bore and thereby generate excess pressure in the drill string when the drill string moves down, and to allow additional drilling fluid to be pushed through the bore and out of the fluid connection under the excess pressure when the drill string moves upward.

13. A downhole tool according to claim 12, wherein the sensor comprises:

a sensor configured to measure the motion of the downhole tool, preferably the velocity or acceleration; and/or a sensor configured to measure the pressure of the drilling fluid inside the bore of the downhole tool, preferably above and below the controllable dynamic restriction, and/or a sensor configured to measure the pressure of the drilling fluid outside of the downhole tool.

14. A floating drill rig comprising the drill apparatus or downhole tool of claim 12.

15. A floating drill rig according to claim 14, wherein the floating drill rig is a managed pressure drill rig.

16. A method for reducing pressure fluctuations in bottom hole pressure generated by the heaving motion of a floating drill rig, wherein the floating drill rig comprises a drill string configured to receive a drilling fluid through a bore thereof, and a fluid connection which allows for transfer of drilling fluid from within the drill string to outside of the drill string, the method comprising:

controlling the transfer of the drilling fluid from within the drill string to outside of the drill string by restricting flow of the drilling fluid through the bore to generate excess pressure in the drill string when the drill string moves down and allowing additional drilling fluid to be pushed through the bore under the excess pressure when the drill string moves upward.

17. A method according to claim 16, comprising continuously circulating the drilling fluid.

18. A method according to claim 16 comprising measuring the motion of the drill string, using the velocity or acceleration, and/or measuring the pressure of the drilling fluid within the drill string, above and below the controllable restriction, and/or measuring the pressure of the drilling fluid outside of the drill string, and/or measuring the flow rate of the drilling fluid from the main pump.

19. A method according to claim 16, comprising controlling the transfer of the drilling fluid from within the drill string to outside of the drill string responsive to the velocity of the drill string, the pressure of the drilling fluid above and below the controllable dynamic restriction and the flow rate of the drilling fluid from the main pump.

20. A method according to claim 16, comprising carrying out managed pressure drilling.

21. A method according to claim 16, comprising making a pipe connection and/or tripping whilst the drill string is held in slips.

* * * * *